United States Patent [19]

Terry

[11] Patent Number: 4,611,806

[45] Date of Patent: Sep. 16, 1986

[54] EXERCISE DEVICE FOR BACK AND SPINE

[76] Inventor: Chris E. Terry, 101 S. Monitor Pl., Tucson, Ariz. 85710

[21] Appl. No.: 694,983

[22] Filed: Jan. 25, 1984

[51] Int. Cl.[4] ..... A63B 23/02

[52] U.S. Cl. ..... 272/144; D21/191; 272/109; 272/62; 272/63

[58] Field of Search ..... 272/144, 145, 60–63, 272/109, 93, 123, 112; D21/191

[56] References Cited

U.S. PATENT DOCUMENTS

| | | | |
|---|---|---|---|
| 195,247 | 9/1877 | Atwater | 272/144 |
| D. 216,529 | 3/1970 | Bock | D21/191 |
| D. 267,419 | 12/1982 | Komarnicki | D21/191 |
| 3,006,643 | 10/1961 | Ryan | 272/144 |
| 3,119,613 | 1/1964 | Zbyszko . | |
| 3,521,881 | 7/1970 | Schaevitz | 272/93 |
| 3,709,487 | 1/1973 | Walker | 272/62 X |
| 4,341,378 | 7/1982 | Agyagos | 272/62 |
| 4,369,966 | 1/1983 | Silberman et al. | 272/62 |

*Primary Examiner*—Richard J. Apley
*Assistant Examiner*—David J. Brown

[57] ABSTRACT

This device is for exercising a person's back and spine. Primarily, it consists of a tubular frame, having an upper rear handle grip and a lower front handle grip. It further includes a pad on its top for the user and it also includes hooks for the placement of a bar bell, for use by person using the device.

1 Claim, 4 Drawing Figures

FIG. 1
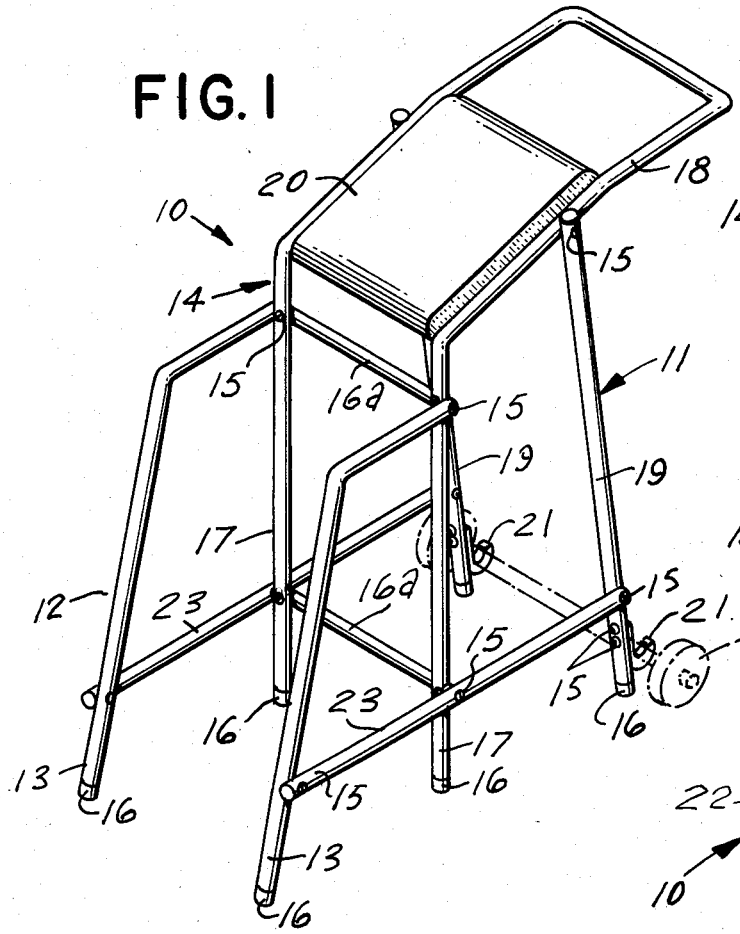
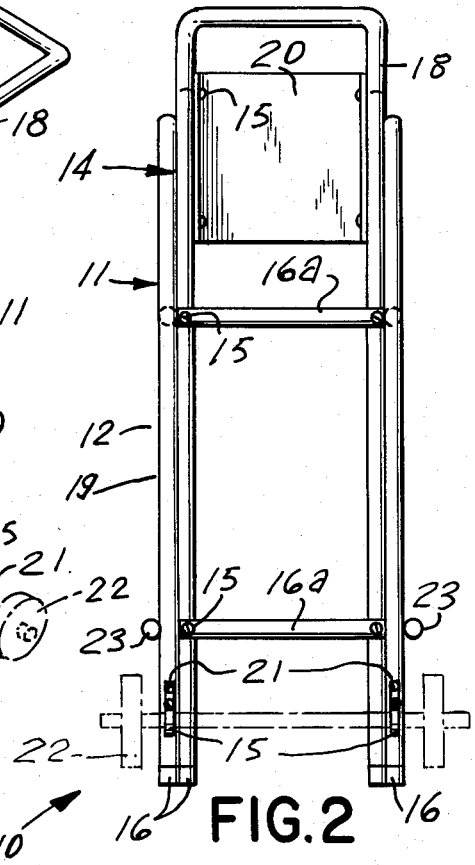
FIG. 2
FIG. 3
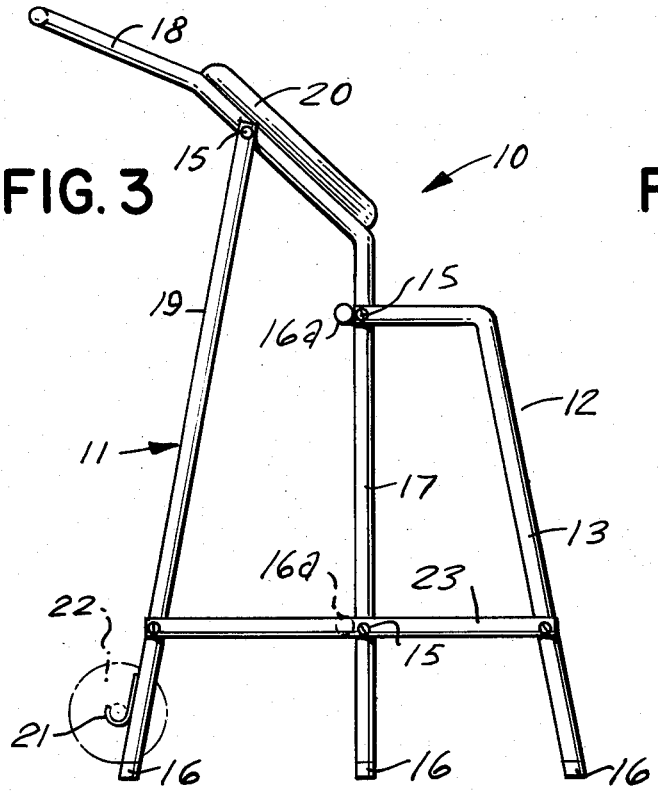
FIG. 4
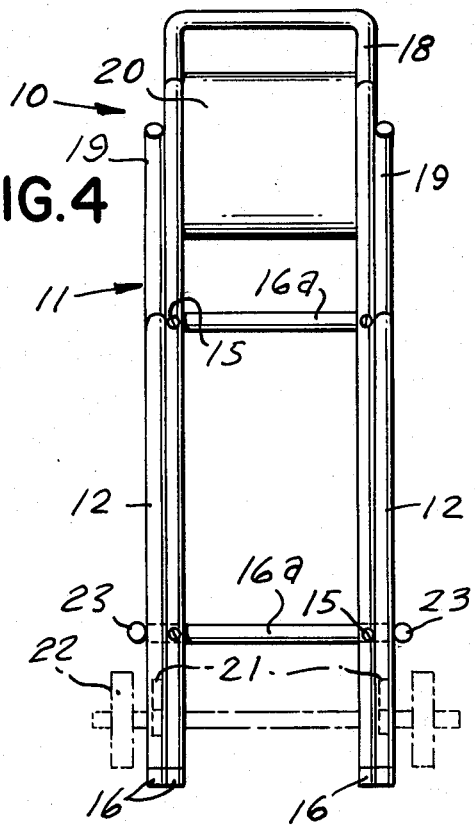

EXERCISE DEVICE FOR BACK AND SPINE

RELATED APPLICATION

This invention relates to manual exercise apparatus, and more particularly, to an exercise device for back and spine.

SUMMARY OF THE INVENTION

The principal object of this invention is to provide an exercise device for back and spine, which will be unique in design for stretching and elongating a person's back and spine, without the use of inversion systems, which can be dangerous to some people, because hanging upside down is unnatural, and undesirable for anyone with high blood pressure, and other likely candidates for aneurisms and a wide variety of other problems.

Another object of this invention is to provide an exercise device for back and spine, which will be adaptable to those who love the benefits of this kind of stretching, but cannot hang upside down, as is done with inversion devices, and the present invention is so designed, as to employ the weight of the user's legs, buttocks, and pelvic area to stretch the back, and the structure includes an angled pad, causing the back to stretch and spread, while gravity acts as the pulling apart force.

A further object of this invention is to provide an exercise device for back and spine, which will be of such design, that the user's body will be kept upright, causing no danger due to health problems, and the device is also such, that dips as well as inverted sit-ups may be performed.

Other objects are to provide an exercise device for back and spine, which is simple in design, inexpensive to manufacture, rugged in construction, easy to use, and efficient in operation.

These, and other objects, will be readily evident, upon a study of the following specification, and the accompanying drawing, wherein:

BRIEF DESCRIPTION OF THE DRAWING FIGURES

FIG. 1 is a perspective view of the present invention, showing a bar bell in phantom lines;

FIG. 2 is a rear elevational view of FIG. 1;

FIG. 3 is a left side elevational view of FIG. 1, and

FIG. 4 is a front view of FIG. 3.

DETAILED DESCRIPTION OF PREFERRED EMBODIMENT

Accordingly, a device 10 is shown to include a tubular frame 11, which consists of a front hand rail stabilizer 12, which is composed of a pair of legs 13 fastened fixedly, at their upper ends, to a center main member 14 by suitable fasteners 15. A cross-piece stabilizer 16*a* is also fastened fixedly to member 12 at the end portion sections of legs 13, by similar fasteners 15, and legs 13 include suitable plastic feet 16 received thereon. Center main member 14 is of inverted "U"-shape, and also includes feet 16 on the lower ends of its legs 17, and its upper portion is formed angularly upward and is a handle grip 18, which is reinforced by means of a pair of rear legs 19. Legs 19 are fixedly secured at their upper ends to a midportion of grip 18 by fasteners 15, and also include feet 16 on their bottom ends. A back pad 20 is suitably secured to the forward top portion of center main member 14, by suitable fasteners 15, and a pair of hooks 21 are fixedly secured to the rear lower portions of rear legs 19, by fasteners 15, and provide support means for a bar bell weight 22. A pair of right and left stabilizers 23 are fixedly secured to legs 13, 17, and 19, by fasteners 15, and a similar cross-piece stabilizers 16*a* is also secured fixedly to legs 17 and stabilizers 23 by fasteners 15.

In use, the person who intends to use device 10 may employ a stool to mount upon it, and a safe way to stretch and elongate the spine, without risk, is to place the back on the pad 20, while standing between legs 13, and gripping handle grip 18. An excellent way to develop the abdomen, which is recommended only for people in good health, is for them to sit upon pad 20 with the head toward the front of the device 10. They then place their feet under the grip 18, which will render them secure as they perform sit-ups, and it is to be noted, that the body is inclined head downward when performing such exercise.

While various changes may be made in the detail construction, it is understood that such changes will be within the spirit and scope of the present invention, as is defined by the appended claims.

What I now claim is:

1. An exercise device for the back and spine comprising in combination, a tubular framework and a back pad affixed to said framework; said tubular framework consisting of a central frame, a front handrail stabilizer, a pair of rear legs and a plurality of cross braces rigidly securing said central frame between said handrail stabilizer and said rear legs; said central frame comprising a pair of elongated parallel bars extending upwardly from a first end to a transverse obtuse bend across both of said parallel bars forming a rearwardly, upwardly angularly inclined portion and a U-shaped portion extending between and connecting said parallel bars at a second end opposite said first end; said pair of rear legs each comprising a straight tube connected to said inclined portion and extending downwardly to support said inclined portion of said central frame; and said front handrail stabilizer comprising a pair of spaced apart downwardly extending angle shaped handrails connected to said central frame; wherein said back pad is affixed to a lower portion of said inclined portion of said central frame, said lower portion of said inclined portion being that portion which is immediately above said obtuse bends in said parallel bars.

* * * * *